US005370374A

United States Patent [19]

Rodgers et al.

[11] Patent Number: 5,370,374

[45] Date of Patent: * Dec. 6, 1994

[54] NESTABLE SPRING ASSEMBLIES FOR BEDDING AND FURNITURE

[75] Inventors: William C. Rodgers; Arval W. Barnes, Sr., both of Lexington, Ky.

[73] Assignee: Hoover Group, Inc., Alpharetta, Ga.

[ * ] Notice: The portion of the term of this patent subsequent to Jan. 12, 2010 has been disclaimed.

[21] Appl. No.: 145,026

[22] Filed: Oct. 28, 1993

Related U.S. Application Data

[63] Continuation of Ser. No. 628,086, Dec. 17, 1990, Pat. No. 5,178,372, which is a continuation of Ser. No. 963,102, Oct. 19, 1992, abandoned.

[51] Int. Cl.[5] ..... F16F 3/00

[52] U.S. Cl. ..... 267/103; 5/255

[58] Field of Search ..... 5/247, 255, 257, 263, 5/267, 268, 476; 267/80, 83, 103

[56] References Cited

U.S. PATENT DOCUMENTS

| | | | |
|---|---|---|---|
| 3,777,322 | 12/1973 | Larkin | 5/267 |
| 4,685,659 | 8/1987 | Hagemeister | 267/103 |
| 4,730,358 | 3/1988 | Zapletal | 5/247 |
| 4,739,977 | 4/1988 | Dabney | 267/103 |
| 4,862,532 | 9/1989 | Wells et al. | 5/247 |
| 4,903,949 | 2/1990 | Schulz, Jr. | 267/103 |
| 4,921,228 | 5/1990 | Lowe | 267/103 |
| 5,052,064 | 10/1991 | Hagemeister et al. | 5/247 |

*Primary Examiner*—Robert J. Oberleitner
*Assistant Examiner*—Chris Schwartz
*Attorney, Agent, or Firm*—Harness, Dickey & Pierce

[57] ABSTRACT

A spring assembly for bedding and furniture which includes a support frame and a grid unit disposed above and in general vertical alignment with the frame, the grid unit including a border wire and cross wires arranged in a criss-cross pattern on said border wire. A plurality of upright spring modules are arranged in a predetermined pattern on the grid unit and supported on said frame, each of the modules being attached in a clipless manner at the upper end thereof to the grid unit so as to be connected to the unit in a manner such that up and down movement of the grid unit results in up and down compression and expansion of the spring modules. Each of the spring modules being a one-piece wire spring of tapered shape to enable spring modules to be arranged in nested stacks for shipping and storage.

2 Claims, 3 Drawing Sheets

NESTABLE SPRING ASSEMBLIES FOR BEDDING AND FURNITURE

This is a continuation of U.S. patent application Ser. No.: 07/628,086, filed Dec. 17, 1990, entitled NESTABLE SPRING ASSEMBLIES FOR BEDDING AND FURNITURE, now U.S. Pat. No. 5,178,372, which is a continuation of U.S. patent application Ser. No. 07/963,102, filed Oct. 19, 1992, entitled NESTABLE SPRING ASSEMBLIES FOR BEDDING AND FURNITURE, now abandoned.

BACKGROUND AND SUMMARY

This invention relates generally to spring assemblies for bedding and furniture foundations for mattresses and seat cushions. Such spring assemblies conventionally consist of a support frame, a wire grid positioned above the support frame, and springs supporting the grid on the frame for yieldable movement under load towards the frame.

Spring assemblies of this type now in use are satisfactory. They consist of metal components such as the springs and the grid and in some cases the frame which are supplied to the bedding or furniture manufacturer for assembly and ultimate sale. In the case of box spring assemblies, various sizes and grades of box spring assemblies are made by the manufacturer and this requires the maintenance by the furniture manufacturer of a large inventory of metal components. There are, therefore, opportunities for improving such spring assemblies particularly from the standpoints of ease of assembly and ease of converting from one grade or size to another.

It is the object of the present invention, therefore, to provide spring assemblies that can be readily assembled without the requirement for the usual clips for connecting springs and grids. It is also an object to provide a spring assembly that can be economically preassembled and nested in compact stacks that can readily be shipped by the manufacturer of the metal grids and springs without danger of shifting or entanglement of parts during transit or storage.

It is a further object of this invention to provide a spring assembly which includes a spring module that can readily be adapted to the manufacture of spring assemblies in a variety of sizes and a variety of spring densities in the assembly.

Further objects, features and advantages of the invention will become apparent from a consideration of the following description and the appended claims when taken in connection with the accompanying drawing.

DETAILED DESCRIPTION

Figure 1:
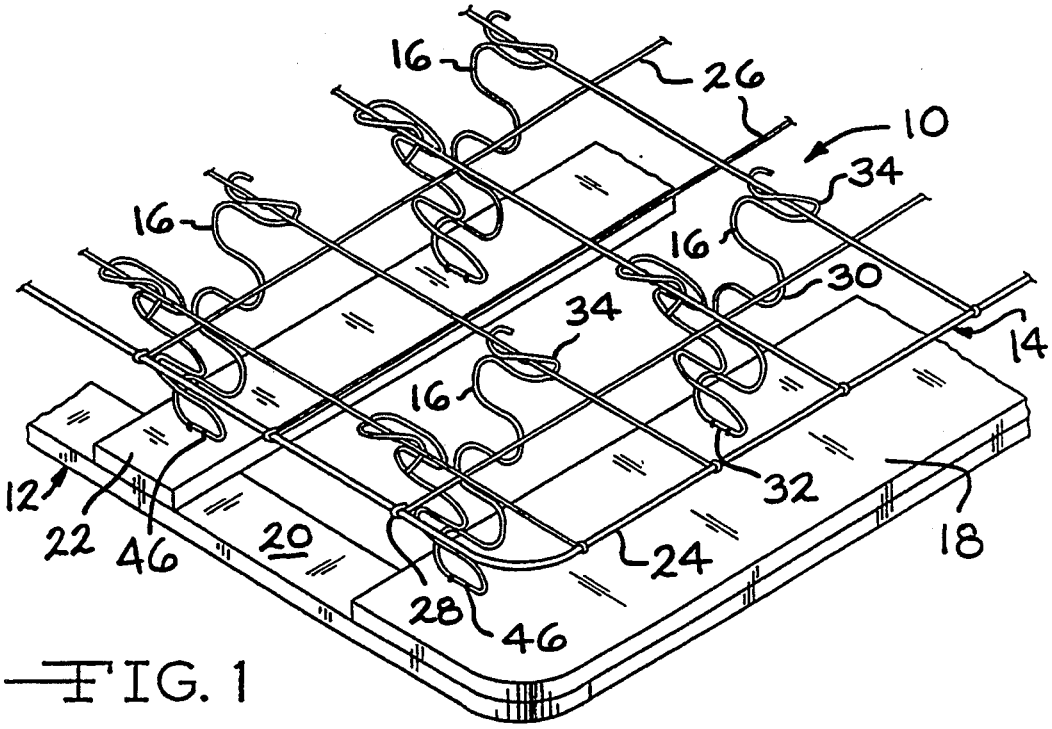
FIG. 1 is a fragmentary perspective view of the spring assembly of this invention in the form of a box spring assembly.

With reference to the drawing, the spring assembly of this invention, indicated generally at 10, is illustrated in FIG. 1 as including a supporting frame 12, only a portion of which is illustrated but which is of generally rectangular shape, a wire grid unit 14, also of rectangular shape, is positioned above and in general alignment with the frame 12 and a plurality of spring modules 16 are mounted on the frame 12 and attached to the wire grid unit 14 so as to support the grid unit 14 at a predetermined elevation above the frame 12.

As shown in FIG. 1, the frame 12 consists of a pair of end rails 18, a pair of side rails 20, and a plurality of cross rails 22. The frame 12 is conventional so only one of each is illustrated in FIG. 1. The wire grid unit 14 consists of a rectangular border wire 24 and a plurality of grid wires 26 which are arranged in a criss-cross fashion and are supported on the border wire 24. In the illustrated embodiment of the grid unit 14, the cross wires 26 are illustrated as having return bent portions forming loops 28 at their ends which are bent around the border wire in order to support the cross wires on the border wire 24.

The spring modules 16 are identical, each comprising a body 30 formed of a single piece of conventional sinuous spring wire and folded, in the preferred embodiment of this invention to a generally V-shape. The V-shape sinuous spring body 30 is generally upright and has a torsion bar 32 at its lower end or apex and upwardly diverging legs 33. At its upper end, the body 30 is formed with horizontally spaced apart attaching portions 34. The attaching portions 34 are configured so that they can be interfitted with adjacent parallel grid wires 26 so as to provide for a clipless attachment of the upper end of the spring module 16 to the grid 14. As a result, the springs 16 are connected to the grid 14 so that up and down movement of the grid 14 in response to bedding loads results in corresponding compression and expansion of the springs 16 in reaction to the loads.

Figure 5:
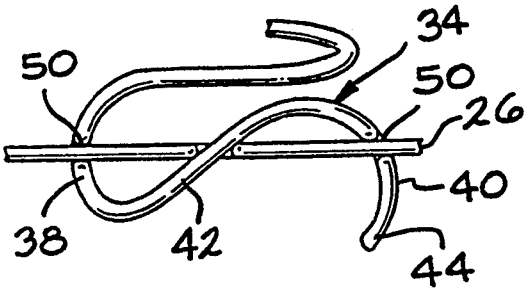
FIG. 5 is an enlarged fragmentary top plan view of the coacting portions of a wire grid and a spring module illustrating how these components are interfitted to provide for a clamped attachment and support of the spring module on the wire grid.
Figure 6:
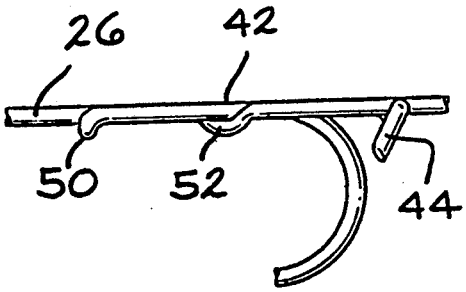
FIG. 6 is a side elevational view of the components illustrated in FIG. 5.
Figure 7:
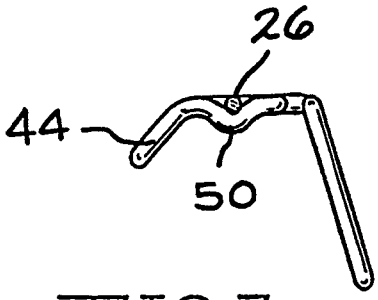
FIG. 7 is a transverse sectional view of the components illustrated in FIG. 5.

As shown in FIGS. 5, 6, and 7, the attaching portion 34 includes an S-shape wire section having generally curved inner and outer end sections 38 and 40, respectively, joined by an elongated center section 42. In attaching a spring module 16 to the wire grid 14, the inner end section 38 is engaged with the underside of the grid wire 26 on which the spring is mounted, the center section 42 is extended over and positioned against the top side of the grid wire 26 and the outer end section 40 is positioned against the under side of the wire 26. The result is that the wire 26 is securely clamped between the end sections 38 and 40 which engage its under side and the center section 42 which engages the top side of the grid wire 26. As shown in FIGS. 6 and 7, the terminal end portion 44 of the attaching section 34 extends downwardly to provide a "lead-in" to facilitate interfitting of the section 34 with the grid wire 26.

To insure against relative movement of the spring module and the grid wires 26, each of said attaching portion end sections 38 and 40 is formed with a notch 50 in the top side thereof shaped to receive a cross wire 26 therein. The center section 42 of the attaching portion 34 extends into a notch 52 in the cross wire 26 as shown in FIGS. 5 & 6.

In the assembly of the wire spring assembly 10, a desired number of spring modules 16 are assembled with the grid wires 26, as shown in FIG. 1, with the modules 16 being arranged in a pre-established pattern to provide a desirable resistance to bedding loads determined by the particular use to which the spring assembly 10 is to be put. The springs 16 with the grid 14 attached to their upper ends, are then supported at their lower ends on the frame 12 and are secured to the frame rails 18 and 22 by means of staples 46 straddling the lower most torsion bar 32 in each spring module 16.

Figure 2:
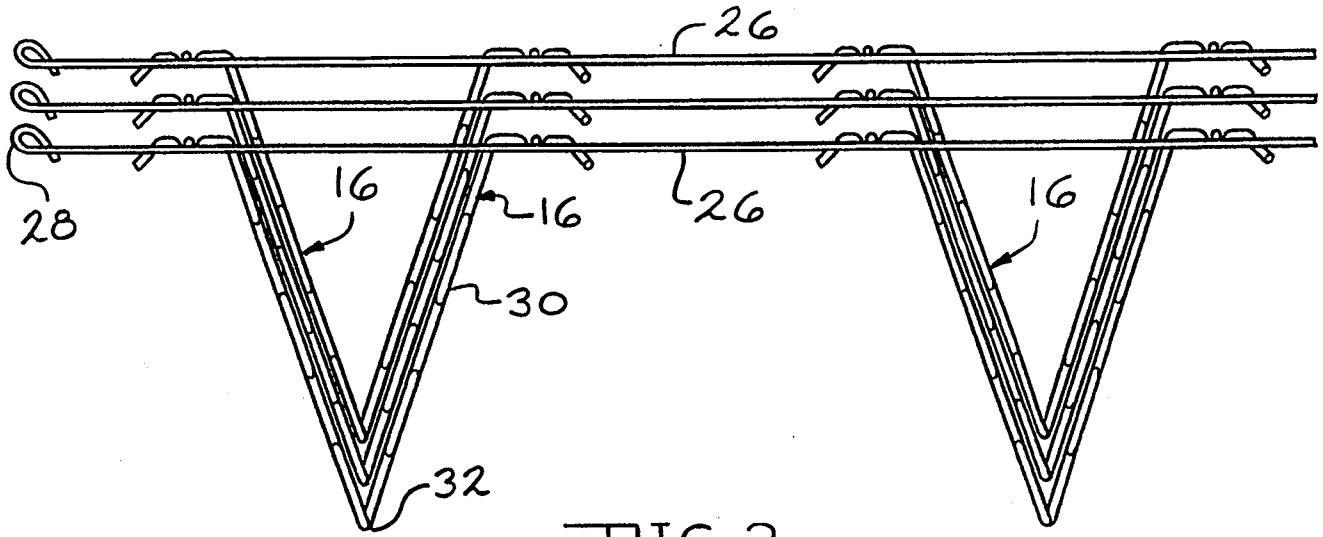
FIG. 2 is a fragmentary transverse sectional view of a nested stack of preassembled nested metal components for spring assemblies of this invention, showing one embodiment of the spring module used in the spring assembly.
Figure 4:
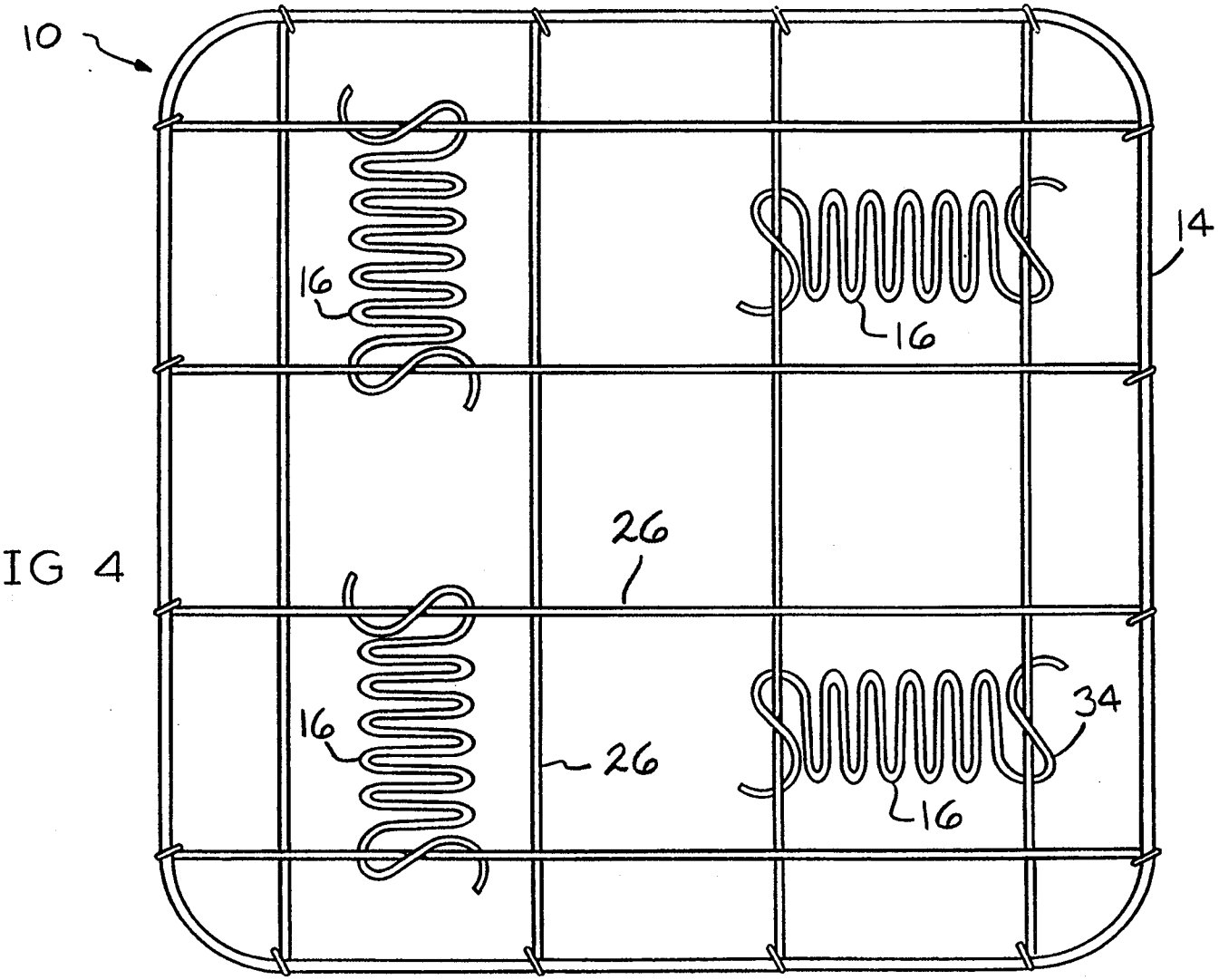
FIG. 4 is a top plan view of a spring assembly of this invention suitable for use in furniture as a foundation for a seat cushion.

As shown in FIG. 2, a sub-assembly consisting of springs 16 and a grid 14 can be prepared at the site of manufacture of the metal components for the spring assembly 10. As shown in FIG. 2, a number of these sub-assemblies can be relatively nested to form a compact stack of sub-assemblies for shipping and storage purposes. To avoid relative movement and shifting of components in the stack during transport or storage, one or more of the spring modules 16 can be arranged at right angles to others of the spring module 16 as illustrated in FIG. 4.

Figure 3:
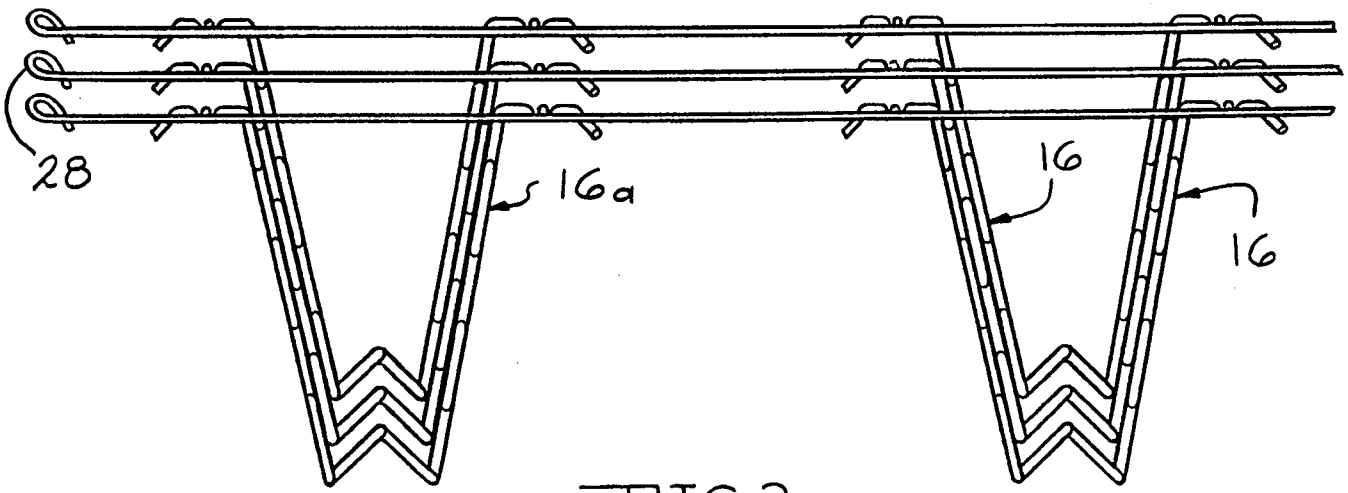
FIG. 3 is a transverse sectional view like FIG. 2 illustrating a modified form of the spring module of this invention.

Also, as shown in FIG. 3, in a modified form of the spring module 16, indicated at **16*a* in FIG. 3, the spring body 30*a* is of a generally "W-shape" with upwardly diverging legs 33*a*, as contrasted to the V-shape of the spring module 16. The fact that the spring modules 16 and 16*a* are open from above and have downwardly tapering sides, enables the relative telescoping and nesting of the spring modules 16 and 16*a* as shown in FIGS. 2 and 3. The sides of the spring modules 16 and 16*a* taper downwardly from the spaced attaching portions 34 to the lower ends of the spring modules. This downward and inward taper is substantially straight and continuous from the upper ends to the lower ends. That is, the taper of the sides is a single taper extending from the upper end to the lower end as shown in FIGS. 2 and 3**. By single taper it is meant that at no location do the sides of the spring modules taper downwardly and outwardly.

A further characteristic of the springs 16 and **16*a* is that the straight downward and inward taper of the spring sides is such that the sides do not cross to avoid entanglement in a stack. Stated otherwise, consider an imaginary center line for spring 16 extending vertically through the center torsion bar 32 at the lower end of the spring 16 (FIG. 2). It is to be noted that each of the downwardly and inwardly tapered sides of the spring body 30 is disposed entirely on one side of the imaginary center line to reduce the likelihood of entanglement of springs 16 and 16*a*** during stacking and during removal from a stack.

At the point of final assembly of the spring assembly 10, usually a furniture or bedding factory, the metal sub-assemblies illustrated in FIGS. 2 and 3 are assembled on frames, such as the conventional wood frame 12 illustrated in FIG. 1, or an equivalent metal frame.

From the above description, it is seen that this invention provides a spring assembly 10 which is advantageous because it provides a spring system of clipless assembly design, provides a system that can be economically pre-assembled and nested in shippable stacks without entanglement during shipping or storage, and provides spring modules 16 and **16*a* that can accommodate the variations in size of grids that occur over a wide range of box and furniture spring widths, as well as variations in quality involving the number of spring modules per spring assembly. These advantages are achieved by the open top, downwardly tapered configuration of the spring modules 16** which are illustrated as being formed of sinuous wire but which can also be advantageously made of formed wire.

We claim:

1. A nestably stackable assembly for use in a bedding foundation comprising:

a rectangular border wire, a plurality of spaced connector wires operably connected to said border wire so as to define a planar top of said assembly, said connector wires defining spaced openings between adjacent ones of said connector wires, a plurality of support springs being of one-piece construction and depending from said plurality of connector wires so as to resiliently support said connector wires for up and down movement, each of said support springs being aligned with one of said openings between said connector wires and each of said support springs having sides tapering downwardly and inwardly in a continuous manner from said planar top to a lower end, each of said spring sides being continuous from top to bottom and located entirely to one side of an imaginary vertical center line extending through the lower end of said spring, said lower ends of said support springs being located in a common base plane and being adapted to be secured to a foundation base, said assembly being constructed such that when one said assembly is placed atop another identical assembly, said one assembly may be nestably stacked within said other assembly when said support springs of said one assembly enter into said support springs of said other assembly, said nested assemblies having a total height dimension only slightly greater than a height dimension of said one assembly.

2. A vertically extending stack of identical assemblies for use in bedding foundations, each assembly in the stack comprising:

a rectangular border wire, a plurality of connector wires operably connected to said border wire so as to define a planar top of said assembly, said connector wires defining spaced openings located between spaced pairs of said connector wires, a plurality of support springs being of one-piece construction and depending from said plurality of connector wires so as to resiliently support said connector wires for up and down movement, each of said support springs being aligned with one of said spaced openings and each of said support springs having sides forming a single downwardly and inwardly taper extending in a continuous manner from said planar top to a lower end, each of said spring sides being continuous from top to bottom and located entirely to one side of an imaginary vertical center line extending through the lower end of said spring, said lower ends of said support springs being located in a common base plane and being adapted to be secured to a foundation base, said assembly being constructed such that when one said assembly is placed atop another identical assembly, said one assembly may be nestably stacked within said other assembly when said support springs of said one assembly enter into said support springs of said other assembly to form said vertically extending stack.

* * * * *